US006309178B1

(12) United States Patent
Kim et al.

(10) Patent No.: US 6,309,178 B1
(45) Date of Patent: Oct. 30, 2001

(54) DOWNSTREAM GUIDING DEVICE FOR FAN-RADIATOR COOLING SYSTEM

(76) Inventors: Young S. Kim, 1580 Dana Ct., Fridley, MN (US) 55432; William F. Gevers, 2177 Park Ave., White Bear Lake, MN (US) 55110; Constantine Xykis, 714 Bridle Ridge Rd., Eagan, MN (US) 55120

( * ) Notice: Subject to any disclaimer, the term of this patent is extended or adjusted under 35 U.S.C. 154(b) by 0 days.

(21) Appl. No.: 09/400,736

(22) Filed: Sep. 22, 1999

(51) Int. Cl.[7] ..... F04D 29/58

(52) U.S. Cl. ..... 415/176; 415/208.2; 415/211.2

(58) Field of Search ..... 415/211.2, 208.2, 415/210.1, 191, 192, 176, 220; 416/189, 192, 169 A; 165/DIG. 311, DIG. 316, DIG. 317; 290/1 B; 123/41.49, 41.65

(56) References Cited

U.S. PATENT DOCUMENTS

| | | | | |
|---|---|---|---|---|
| 2,814,433 | * | 11/1957 | Brinen | 415/210.1 |
| 4,357,914 | | 11/1982 | Hauser | 123/41.49 |
| 4,548,548 | | 10/1985 | Gray, III | 416/189 |
| 4,590,889 | * | 5/1986 | Hiereth | 123/41.05 |
| 4,871,298 | | 10/1989 | Vera | 416/189 |
| 5,172,752 | | 12/1992 | Goetz, Jr. | 165/41 |
| 5,244,347 | | 9/1993 | Gallivan et al. | 416/189 |
| 5,273,400 | | 12/1993 | Amr | 416/189 |
| 5,342,173 | * | 8/1994 | Vera | 416/169 A |
| 5,454,695 | | 10/1995 | Shah et al. | 416/203 |
| 5,730,583 | | 3/1998 | Alizadeh | 416/189 |
| 5,755,557 | | 5/1998 | Alizadeh | 416/193 R |
| 5,758,716 | * | 6/1998 | Shibata | 165/41 |
| 5,791,876 | * | 8/1998 | Moser | 416/170 R |
| 5,845,612 | | 12/1998 | Lakerdas et al. | 123/41.44 |

FOREIGN PATENT DOCUMENTS

| | | | |
|---|---|---|---|
| 4305928 | 9/1994 | (DE) | F15B/21/04 |
| 19804255 | 8/1999 | (DE) | F01P/5/06 |
| 0761982 | 3/1997 | (EP) | F04D/29/58 |
| 2772844 | 6/1999 | (FR) | F04D/29/54 |

OTHER PUBLICATIONS

"Axial Flow Fans", Library of Congress Cataloguing–in–Publication Data, 4.18–4.21, (1998).

"Fans Axial Flow", Genium Publishing, 7–8, (Apr., 1983).

Lakshminarayana, B., "Fluid Dynamics and Heat Transfer of Turbomachinery.", Library of congress Cataloguing–in–Publication Data, A Wiley–Interscience Publication, 3 pp., (1996).

Lewis, R.I., "Turbomachinery Performance Analysis", Library of Congress Cataloguing–in–Publication, 1 p., (1996).

* cited by examiner

*Primary Examiner*—Edward K. Look
*Assistant Examiner*—Ninh Nguyen
(74) *Attorney, Agent, or Firm*—Schwegman, Lundberg, Woessner & Kluth, P.A.

(57) ABSTRACT

A guiding device for use with a fan-radiator cooling system wherein the fan is upstream from the radiator. The guiding device comprises a series of guide vanes in combination with at least one guide ring. When placed between the fan and the radiator, the device improves the heat transfer capacity of the cooling system by directing air flow through the radiator center, a region that typically suffers from reduced flow due to the air flow pattern in and around the fan hub. Furthermore, the guide vanes align the air flow from the fan so that it is generally parallel with the axis of the fan. The guiding device permits greater heat removal with a given fan and radiator without increasing the speed of the fan.

21 Claims, 6 Drawing Sheets

DOWNSTREAM GUIDING DEVICE FOR FAN-RADIATOR COOLING SYSTEM

TECHNICAL FIELD

This invention relates generally to cooling systems and, more particularly, to a guiding device for use with a fan-radiator cooling system wherein the radiator is positioned downstream from the fan.

BACKGROUND OF THE INVENTION

Cooling systems capable of removing a heat load from a heat-producing source are well known. For modest loads, a forced air system is often adequate. Forced air systems typically utilize an axial or centrifugal fan to pull or push air across the heat-producing source. For more substantial heat loads such as internal combustion engines, a liquid coolant heat exchanger or "radiator" may be used in conjunction with the fan.

The fan typically comprises a series of fan blades coupled to a spinning hub and positioned to direct ambient air flow over the radiator. The radiator comprises a plurality of tubes which are oriented generally normal to the fan axis. Each tube includes a series of fins to increase its surface area (and thus its heat transfer capacity). A liquid coolant is circulated through the heat-producing source wherein it absorbs heat energy. The coolant then passes through the radiator tubes, transferring heat energy through the tubes and fins to the ambient air flowing through the radiator. The cooled liquid is then routed back through the heat-producing source where it is once again heated. Accordingly, heat energy is continuously removed by the liquid coolant and transferred to the moving air.

Generally speaking, fan-radiator cooling systems can be classified based on the direction of air flow. In "pull" systems, the fan is positioned downstream from the radiator wherein it draws or pulls air therethrough. Pull systems are commonly found on motor vehicles such as automobiles and on some industrial cooling systems. Fan-radiator cooling systems may also be configured as "push" systems. As the name implies, push systems position the fan upstream from the radiator where the fan exhausts or pushes air through the radiator. Push-type systems are often selected based on packaging or installation limitations or where it is desirable to have cooler air passing over the fan. The present invention is directed to push-type systems and the remainder of the discussion will focus accordingly.

While push-type fan-radiator systems are effective heat exchangers, problems nevertheless remain. One problem is related to the flow characteristics of the axial fan. In particular, the output of an axial fan is not entirely axial but rather helical. The resulting flow thus has both an axial and a circumferential component. Since the circumferential flow component is not aligned with the tubes and fins of the radiator (i.e., it is not normal to the radiator surface), it contributes little to cooling. Rather, this circumferential flow increases entrance loss into the radiator, degrading overall efficiency.

Yet another problem with these systems is caused by the fan hub. Specifically, since the fan blades do not extend inwardly past the hub, the fan is unable to efficiently generate air flow into the region of the radiator that is aligned with the hub. Accordingly, a lower volumetric flow rate exists in and around the radiator center region. Stated alternatively, an inactive zone is produced in the radiator center wherein coolant flowing therethrough is unable to transfer the same amount of heat energy as coolant flowing elsewhere through the radiator. Thus, the overall heat removal capacity of the radiator is reduced. Depending on such factors as hub size, fan/radiator spacing and fan speed, the effect of the inactive zone on heat removal may be substantial.

While not known for use with fan-radiator systems, downstream guide vanes are often used with axial compressors and the like to address the problem of flow alignment. Downstream guide vanes collect air discharged by the compressor and redirect it in a generally axial direction. Unfortunately, these guide vanes do nothing to address the reduced flow through the inactive zone as discussed above.

Another means to increase volumetric flow is to increase the size of the radiator and fan or, alternatively, increase the fan speed. While these solutions improve overall heat transfer, they are disadvantageous in terms of cost, size and power requirements. In addition, they too do not address the issue of flow in the inactive zone.

Thus, there are unresolved issues with current fan-radiator cooling systems. What is needed is a push-type fan-radiator system that provides uniform, axial air flow through the radiator and, in particular, provides improved flow to the portion of the radiator located directly downstream from the fan hub. What is further needed is a system that can provide this uniform flow while minimizing pressure loss.

SUMMARY OF THE INVENTION

A device to control air flow between a fan and a radiator in a fan-radiator cooling system is provided comprising a plurality of guide vanes that radiate outwardly about a first axis from a first, inner diameter to a second, outer diameter. The device further includes a generally annular guide ring coupled to the guide vanes, wherein the guide ring is adapted to direct a portion of the air flowing through the device toward an inactive region of the radiator.

A method for using an axial fan to push air through a radiator is also provided. The method comprises providing a cooling system having an axial fan. The fan has a plurality of blades coupled to a rotating hub wherein the hub is adapted to selectively receive power from a power source. The system further includes a radiator positioned generally perpendicular to an axis of the axial fan and located downstream therefrom, and a guiding device intermediate the fan and radiator. The method also includes generating air flow by selectively engaging the power source to rotate the fan blades and directing the air flow with the guiding device so that a portion of the flow is directed to a center region of the radiator.

In another embodiment, a fan-radiator cooling system is provided including an axial fan having a plurality of fan blades emanating from a central hub wherein the central hub has a hub diameter and the fan blades define a blade diameter. The system further includes a radiator downstream and spaced apart from the axial fan and a guiding device between the axial fan and the radiator. The device includes a plurality of stationary guide vanes that radiate outwardly about a first axis from a first, inner diameter to a second, outer diameter; and a generally annular guide ring coupled to the guide vanes. The guide ring is adapted to direct a portion of the air flowing through the device toward a center region of the radiator, the guide ring defining a second axis substantially coaxial with the first axis.

In yet another embodiment, a generator set is provided which includes a heat-producing prime mover; a converting apparatus that converts work output of the prime mover into electrical energy; and a cooling system for removing heat generated by the prime mover. The cooling system includes an axial fan having a plurality of fan blades emanating from a central hub. Also included is a radiator downstream and spaced apart from the axial fan and a guiding device between the axial fan and the radiator. The guiding device is comprised of a plurality of stationary guide vanes that radiate outwardly about a first axis from a first, inner diameter to a second, outer diameter; and a generally annular guide ring coupled to the guide vanes, wherein the guide ring is adapted to direct a portion of the air flowing through the device toward a center region of the radiator, the guide ring defining a second axis substantially coaxial with the first axis.

Advantageously, the present invention provides an improved fan-radiator cooling system. By sitting between the fan and radiator, the guiding device of the present invention allows more uniform flow through the radiator by redirecting a portion of the flow to the radiator center. Accordingly, inefficiencies attributable to reduced flow through the radiator center are minimized or eliminated. Thus, a given heat load can be removed with a smaller fan and radiator than would otherwise be required. In addition, the guiding device redirects non-axial flow so that it is generally parallel with the fan axis, thus providing smoother flow through the radiator. Smoother flow equates with reduced entrance loss, which in turn, permits higher volumetric flow. The redirection of flow also results in a conversion of kinetic (i.e., velocity) energy into static pressure, which also contributes to increased air flow through the radiator. Thus, the overall efficiency of the cooling system is increased.

BRIEF DESCRIPTION OF THE DRAWINGS

The invention described herein will be further characterized with reference to the drawings, wherein.

DETAILED DESCRIPTION OF THE EMBODIMENTS

In the following detailed description of the embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Generally speaking, the instant invention is directed to a push-type fan-radiator cooling system. In particular, the invention is directed to a guiding device for guiding the flow of air from the fan and uniformly distributing it over the entire radiator face including the radiator center region. The radiator center typically experiences reduced air flow in push-type systems. This is primarily due to the fact that the flow-producing blades do not extend into the hub region. As such, a region of reduced flow exists directly downstream (i.e., axially aligned) from the fan hub near the radiator center. Because the air flow is reduced, the ability of the radiator to transfer heat from this region is also diminished. The area affected by this reduced flow will hereinafter be referred to, for lack of a better term, as the inactive region or zone. Since the inactive zone has diminished capacity to transfer heat, overall heat transfer capacity of the cooling system is likewise decreased. To counteract this problem, fan engineers have generally had to provide larger fans and/or larger radiators to remove a given heat load.

The present invention permits diversion of a portion of the fan-generated air flow to the center of the radiator, increasing the volumetric flow rate in the inactive zone and thus improving the heat transfer capacity of the radiator through that region. While the invention may be utilized in most any system requiring a push-type cooling system, the inventors perceive one particularly advantageous application is with generator sets and the remainder of this discussion will address the same.

With this brief introduction, attention will now be focused on exemplary embodiments of the invention. While the embodiments that follow are described in sufficient detail to enable one skilled in the art to make and use the invention, the reader is reminded that they are nonetheless exemplary and, as such, are not intended to limit the scope of the invention in any way.

Figure 1:
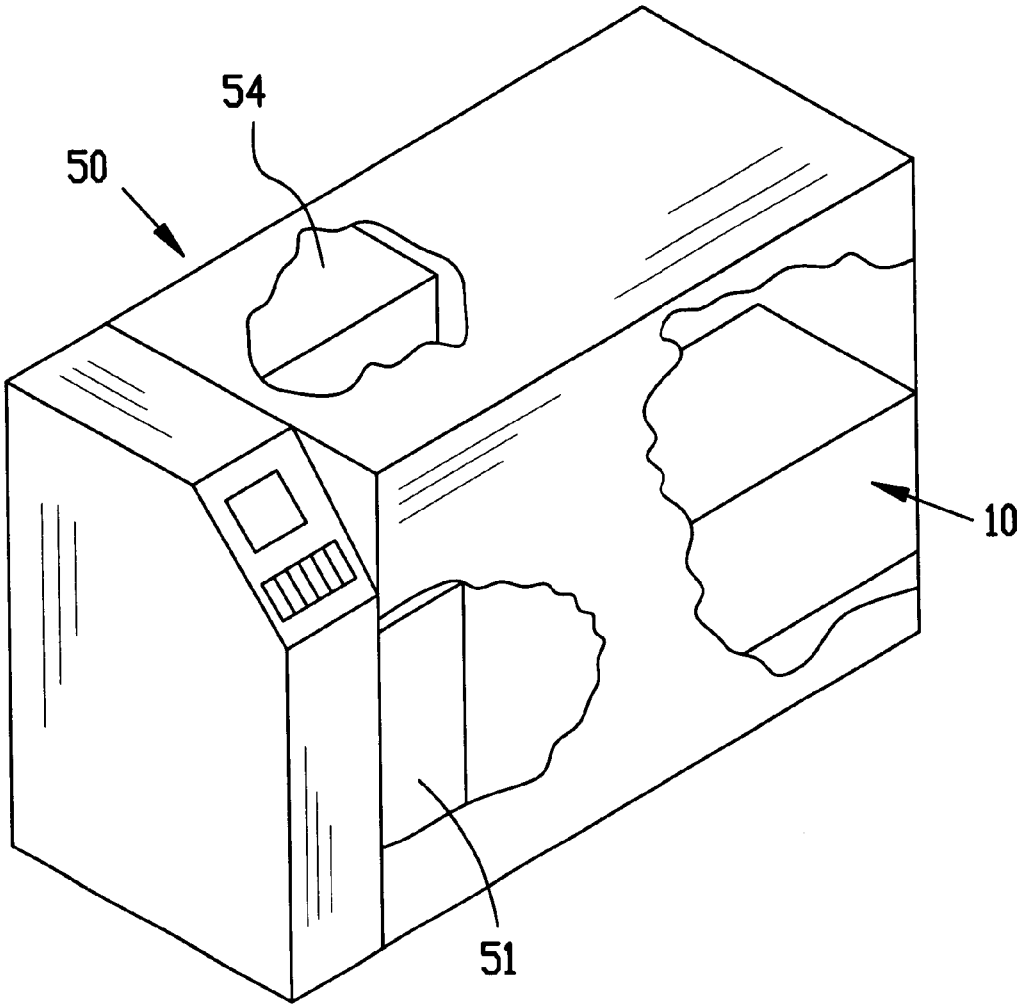
FIG. 1 is a diagrammatic perspective view of a generic generator set having a cooling system in accordance with one embodiment of the invention.

Referring first to FIG. 1, a generator set 50 is illustrated having a cooling system 10 therein. The generator set includes a converting apparatus 51 which converts mechanical work done by a prime mover—such as a internal combustion engine 54—into electrical energy. Generators sets are used for various purposes such as emergency backups and as remote power supplies to name a few.

Figure 2:
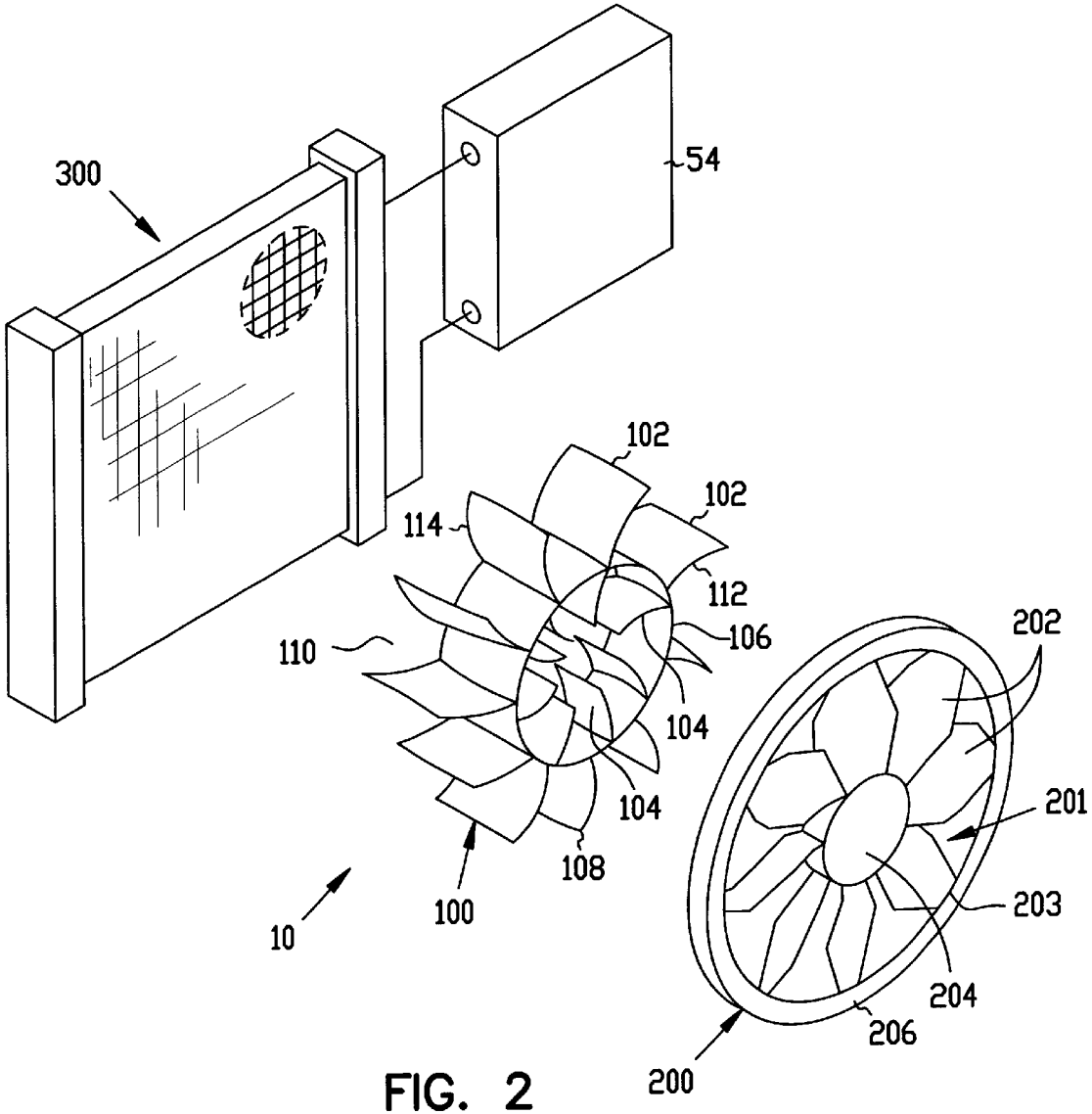
FIG. 2 is an diagrammatic, exploded perspective view of a fan-radiator cooling system in accordance with one embodiment of the present invention.

Referring now to FIG. 2, the cooling system 10 is shown in an exploded perspective view. The system, in one embodiment, comprises a guiding device 100, a fan assembly 200 and a radiator or radiator assembly 300. Although not central to the invention, the operation of the fan and radiator assemblies will be briefly described. The fan assembly 200 includes an axial fan 201 having a plurality of blades 202 coupled to a central, rotating hub 204. The fan blades 202 are airfoil shaped or alternatively, generally planar. Each blade has a distal tip 203 which defines the blade diameter. The blades, in one embodiment, are surrounded along their distal tip 203 by a circumferential shroud 206. A power source such as an electric motor 208 (see FIG. 8), supported by a series of radial supports (not shown) connected to the shroud 206, is operatively coupled to an axis of the hub 204 to selectively rotate the fan 201.

Figure 3:
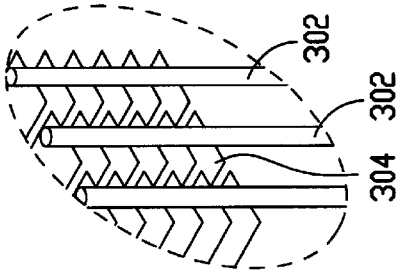
FIG. 3 is an enlarged view of a portion of the radiator of FIG. 2.

Mounted downstream of the fan assembly 200 generally perpendicular to the fan axis is the radiator assembly 300. The radiator assembly is a heat exchanging device used to remove heat from a heat-producing source which, for purposes of this discussion, will hereinafter be referred to as the internal combustion engine 54. In operation, fluid circulated through the engine absorbs heat therefrom. The fluid then passes through a plurality of tubes 302 (see FIG. 3) located within the body of the radiator assembly 300. Each tube 302 has a plurality of fins 304 attached thereto. As the fluid moves through the tubes, air is continually passed through the radiator assembly by the fan assembly 200. By continually moving air across the tubes and fins, beat energy is transferred through the tube walls to the ambient air flow stream where it is carried away and dispersed to the atmosphere.

The fins 304 are used to increase the surface area of the tubes 302 exposed to the passing air, thus further improving the heat transfer capacity of the radiator assembly. After passing through the radiator assembly, the now-cooled fluid is once again recirculated through the engine 54. By repeatedly circulating the fluid through the engine 54 and the radiator assembly 300, heat energy is effectively removed from the generator set 50 (see FIG. 1). To prevent the air flow produced by the fan from exiting circumferentially or radially, a duct 400 (removed for clarity in FIG. 2 but shown in FIG. 8) is provided, in one embodiment, between the downstream side of the fan and the upstream side of the radiator. The duct generally prevents fan-generated air from escaping to atmosphere until it has entered the radiator assembly 300.

Having described the cooling system 10 generally, attention will now be focused on the air flow guiding device 100. When used in conjunction with the fan assembly 200 and radiator assembly 300 described above, the guiding device 100 provides improved air flow through the radiator assembly and more effective heat transfer from the cooling system 10.

Figure 4:
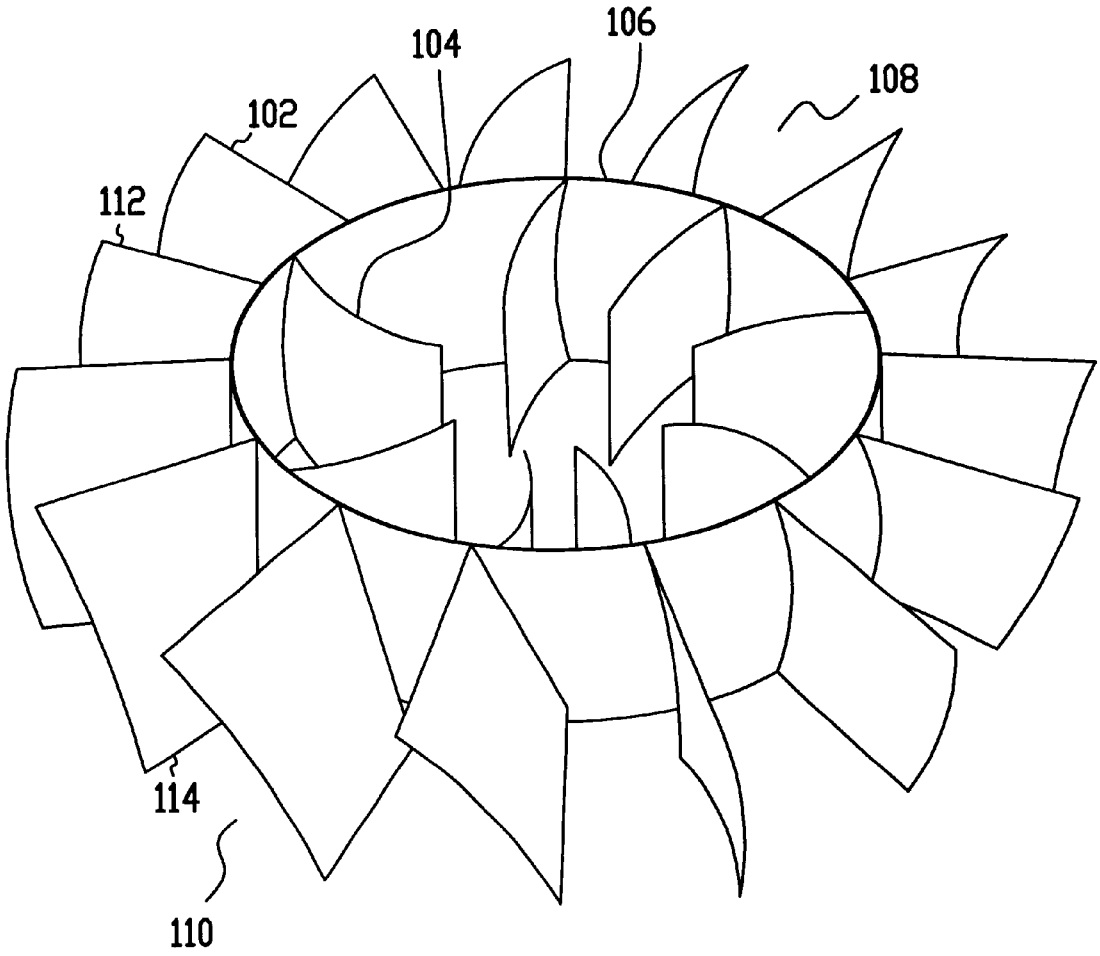
FIG. 4 is a perspective view of a guiding device for use with a fan-radiator cooling system in accordance with one embodiment of the invention.

Referring briefly to FIGS. 2 and 4, the device 100, in one embodiment, is a stationary component that sits between the fan assembly 200 and radiator assembly 300. The device 100 comprises a first plurality of outer guide vanes 102 and a second plurality of inner guide vanes 104. The guide vanes 102, 104 extend outwardly about a common axis to form guide surfaces. The vanes 102 and 104 are each secured to an annular guide ring 106. The device 100 is further defined by a first side 108 located proximal the fan assembly 200 and a second side 110 adjacent the radiator assembly 300. On the first side 108, each vane 102, 104 is defined by a leading edge 112 while, on the second side 110, the vanes are each defined by a trailing edge 114.

Unlike pull-type fan-radiators such as those frequently found in automobiles, the cooling system 10 (see FIG. 2) of the present invention positions the fan assembly 200 upstream from the radiator assembly 300 so that air is pushed through the latter rather than pulled. Pull-type fan systems are not prone to the problems inherent in push-type systems as fans develop generally uniform, axial flow (i.e., flow generally parallel to an axis of rotation of the fan) on their upstream side. Unfortunately, the flow developed on the downstream side of the fan is not nearly as uniform. This problem is partially due to the orientation of the fan blades 202 relative to the axis of the fan. Since the blades are angled (or airfoil shaped) they impart motion to the air not strictly in the axial direction but rather in a direction normal to the blade surface. As such, the downstream flow, while having a predominantly axial component, also has a circumferential or rotational component. Since only axial flow passes smoothly through the radiator, this circumferential flow component is, undesirable.

Accordingly, one object of the guiding device 100 is to capture the flow and redirect it in the axial direction. As such, the leading edges 112 are generally aligned with the direction of air flow exiting the fan while the trailing edges are generally aligned to direct the air flow parallel to the axis of the fan ( i.e., normal to the radiator assembly 300). In the embodiment shown in the figures, this results in a curvilinear guide vane shape. While not required, the inner guide vanes are shaped similar to the outer guide vanes. The shape of the guide vanes 102, 104 permits efficient collection and "straightening" of the air flow discharged by the fan so that it flows generally in the axial direction. The result is that air is passed more smoothly through the radiator. In addition, the redirection of air flow by the vanes 102, 104 results in a conversion of air velocity (kinetic energy) into static pressure, which further increases the flow of air through the radiator assembly 300.

Figure 6:
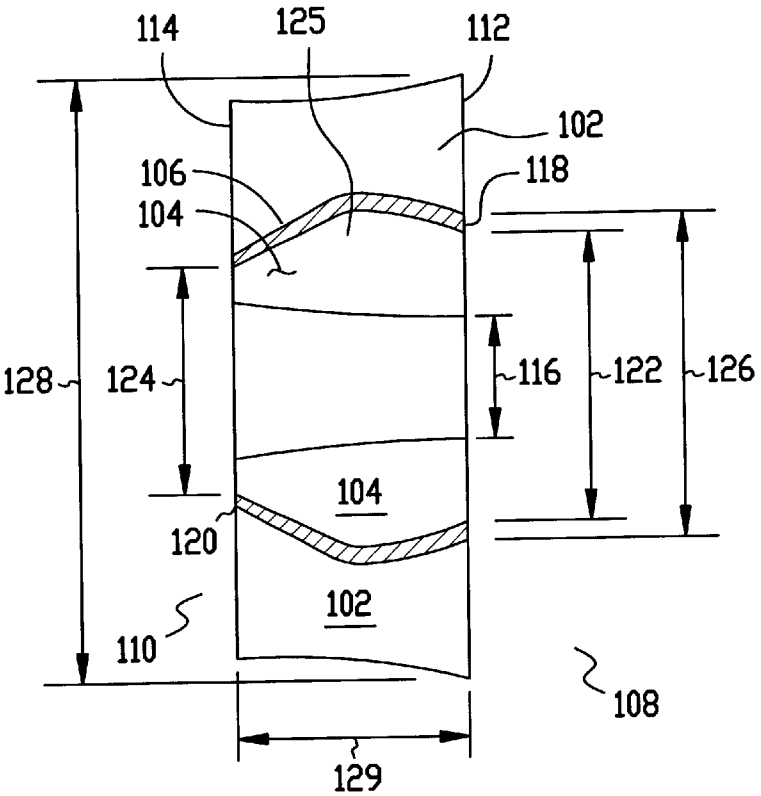
FIG. 6 is a section view of the guiding device of FIG. 5 taken along lines 6—6 of FIG. 5.
Figure 5:
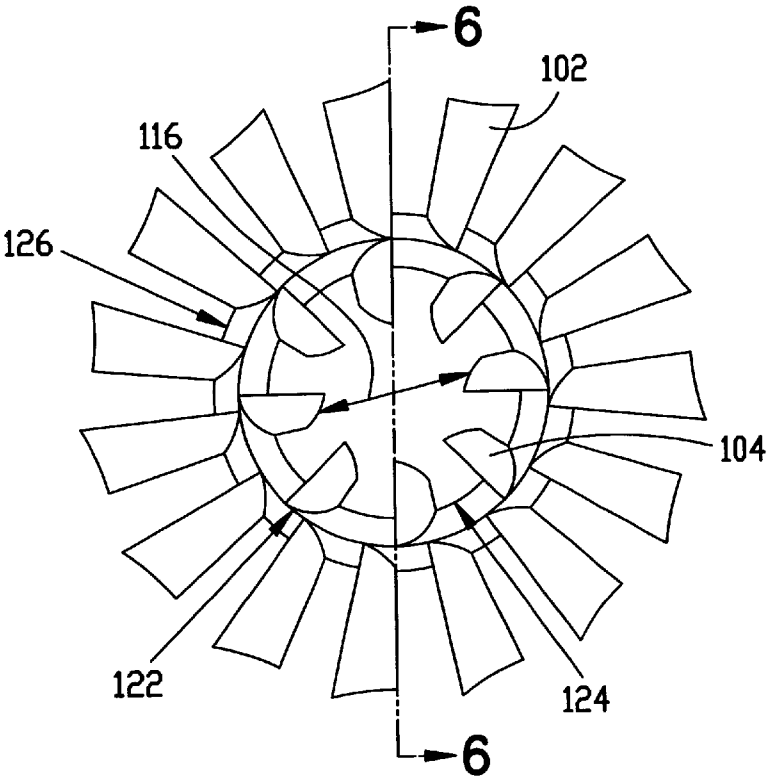
FIG. 5 is a front elevation view of the guiding device of FIG. 4.

While the guide vanes 102, 104 straighten the air flow, it is the guide ring 106 in conjunction with the vanes that directs the air flow to the inactive zone of the radiator assembly 300. Referring particularly to FIGS. 5–6, the inner vanes 104 extend toward the center to define an inner diameter 116. The particular size of the inner diameter 116 is adapted to ensure adequate flow toward the radiator center. The actual size depends on many factors including the fan size, angle/shape of the fan blades and guide vanes, and the relative location and shape of the guide ring, among others. In a typical configuration, the fan motor 208 (see FIG. 8) is located on the side of the fan opposite the device 100. In an alternative embodiment where the fan motor 208 is located between the fan and the device 100 (not shown), the inner diameter 116 is sized to accommodate the fan hub 204 and motor 208 therein (i.e., the fan and hub fit within the inner diameter).

Figure 7:
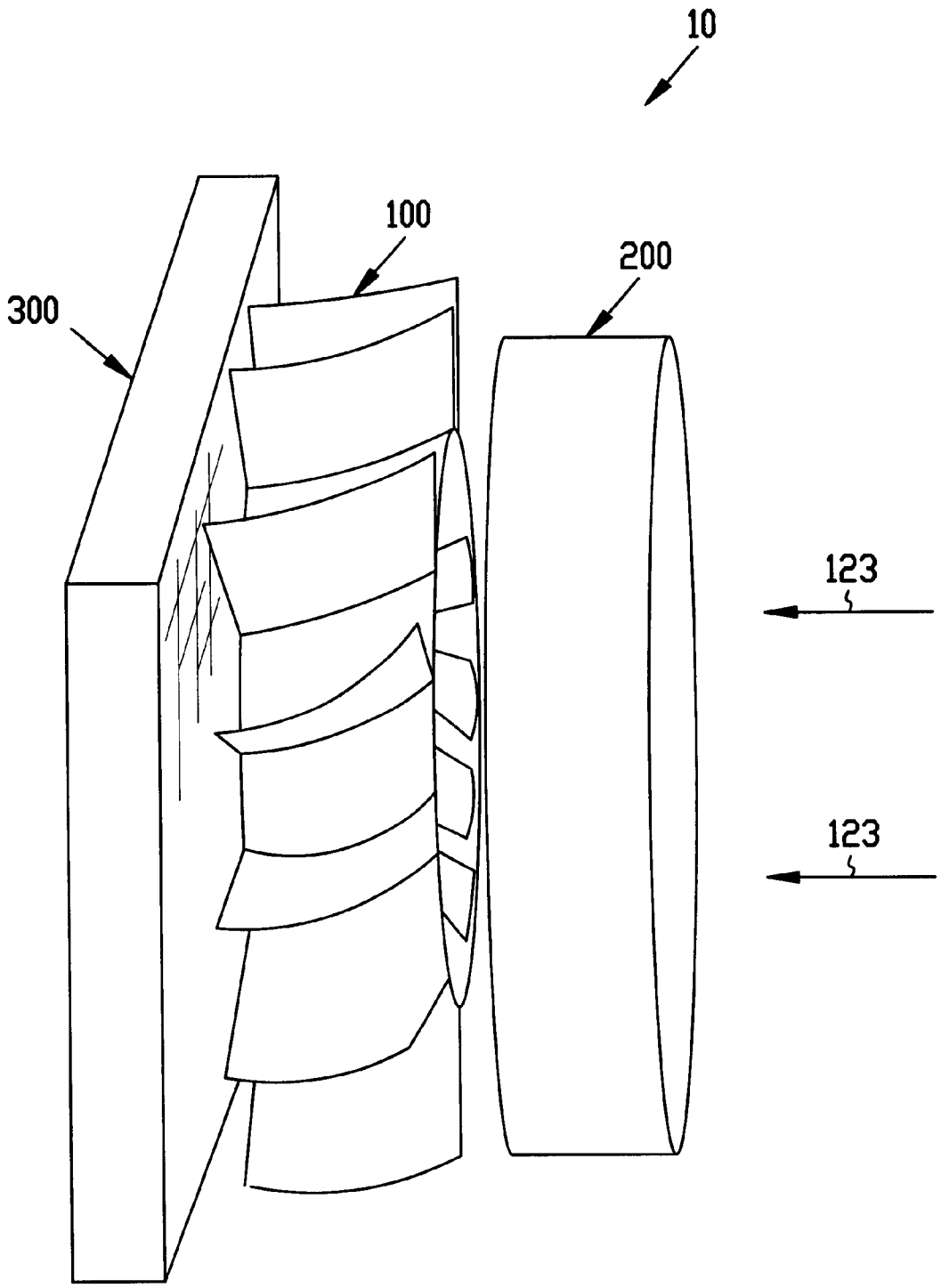
FIG. 7 is a diagrammatic perspective view of a fan-radiator cooling system in accordance with another embodiment of the present invention.
Figure 8:
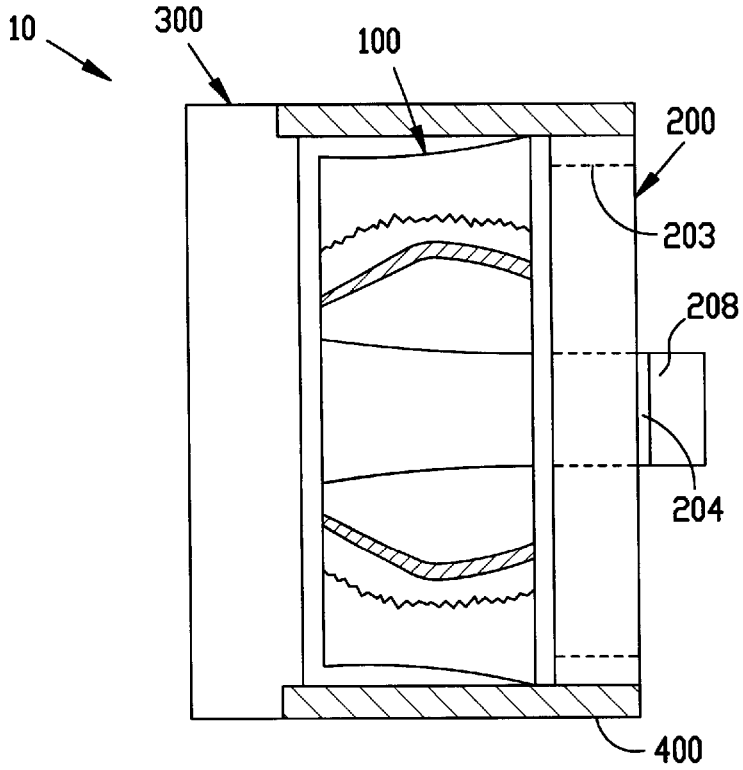
FIG. 8 is a diagrammatic side elevation view of a fan-radiator cooling system in accordance with another embodiment of the present invention.

In the embodiment shown in FIGS. 7 and 8, the device 100 is placed in close proximity to the fan assembly 200 to better capture the circumferential flow generated by the fan. Accordingly, the output of the fan assembly 200 is more efficiently utilized. To further increase efficiency, the device 100, in one embodiment, has an outer diameter 128 (see FIG. 6) larger than the fan blade diameter (i.e., the distance across the distal tips 203 of the fan 201—see FIG. 2) to more effectively collect the air discharged proximal the distal tip 203 of the fan 201.

Referring once again to FIG. 6, the ring 106—like the vanes 102 and 104—also includes a leading edge 118 on the first side 108 and a trailing edge 120 on the second side 110. At the leading edge 118, the ring 106 forms an entrance diameter 122 while at the trailing edge 120 it forms an exit diameter 124. The entrance and exit diameters have a common axis which is generally coaxial with the axis about which the guide vanes 102, 104 extend (and thus, also generally coaxial with axis of the fan). In the embodiment shown, the ring is bowed outwardly towards its center to form a diverging region 125 having an expansion diameter 126. Accordingly, air drawn into the entrance diameter 122 diverges or expands momentarily into the expansion region and then converges toward the exit diameter 124. The convergence of the ring forces air toward the radiator center, effectively eliminating the inactive zone experienced with conventional push-type systems. By controlling the radial location and geometry of the ring 106, the volumetric flow that is redirected towards the center can be controlled. In one embodiment, the ring is located and configured such that the average volumetric flow rate per unit area through the ring is generally equal to the average volumetric flow rate per unit area outside the ring. By controlling the ring size and configuration, uniform flow over the entire radiator surface is achieved. While the bowed ring profile minimizes pressure drop across the ring, other ring configurations (e.g., straight taper from entrance to exit) are also possible without departing from the scope of the invention.

In one embodiment, the leading and trailing edges 118, 120 are generally coplanar with the leading and trailing edges 112, 114 respectively of the vanes 102. That is, the depth of the ring 106 is approximately identical to the vane depth 129 (see FIG. 6). However, embodiments where the ring 106 extends beyond the vanes (in either the upstream or downstream directions) are also possible without departing from the scope of the invention. Similarly, embodiments where the vanes 102, 104 extend beyond the ring 106 are also possible.

Referring now to FIG. 7, the device 100 is shown as positioned between a diagrammatically represented fan assembly 200 and radiator assembly 300. The general direction of air flow through the cooling system is represented by arrows 123. FIG. 8 shows a partial cross section of the assembled system 10. Although the embodiment shown illustrates the motor 208 on the upstream side of the fan, embodiments wherein the motor is located on the downstream side are also possible within the scope of the invention.

In one embodiment, a tubular duct or shroud 400 as shown in FIG. 8 is provided. The duct 400 effectively contains air flowing between the fan assembly 200 and the radiator assembly 300. The duct 400 spans from the downstream side of the fan assembly 200 to the upstream side of the radiator assembly 300. By utilizing the duct 400, air entering the cooling system 10 can then generally exit the system only after passing through the device 100 and the radiator assembly 300. The duct includes mounting provisions for securing the device 100 therein.

In one embodiment, the guiding device 100 comprises fifteen outer guide vanes 102 and eight inner guide vanes 104. However, this configuration is specific to one particular application and embodiments utilizing differing numbers and differing configurations of guide vanes are possible without departing from the scope of the invention.

Figure 9:
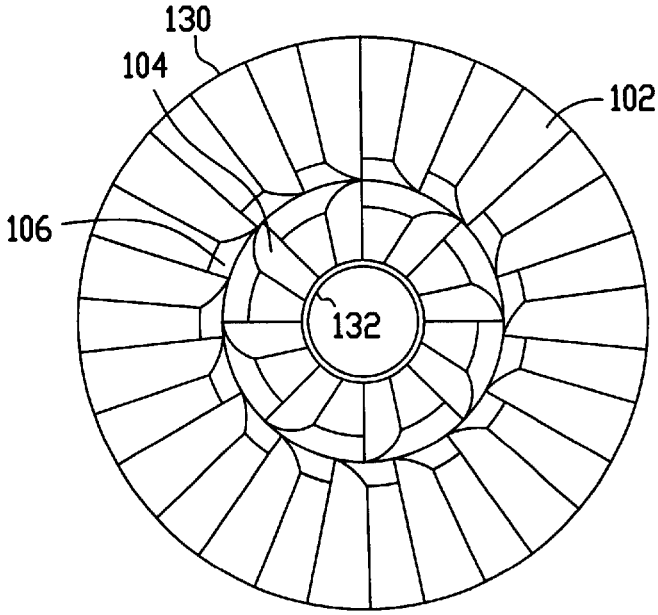
FIG. 9 is a front elevation view of a guiding device in accordance with another embodiment of the invention.

In addition to varying the guide vanes 102, 104, other embodiments such as that shown in FIG. 9 are also possible. FIG. 9 shows the device 100 with supplemental rings 130 and 132 located on the outer diameter 128 and the inner diameter 116 respectively. These rings are used not only to assist with flow containment and direction, but also to provide structural support when the vanes are unusually long or flexible. Like the ring 106, the rings 130, 132, in one embodiment, extend beyond the first or second side 108, 110. Nevertheless, in order to prevent interference with flow into the inactive zone, the leading edge of the ring 132 does not extend substantially beyond the device 100. In one embodiment, the ring 132 has a leading edge which extends beyond the first side 108 of the device 100 a distance of no more than one third the depth 129 (see FIG. 6).

Advantageously, the present invention provides an improved fan-radiator cooling system. By sitting between the fan and radiator, the guiding device of the present invention allows more uniform flow through the radiator by redirecting a portion of the flow to the radiator center. Accordingly, inefficiencies attributable to reduced flow through the radiator center are minimized or eliminated. Thus, a given heat load can be removed with a smaller fan and radiator than would otherwise be required. In addition, the guiding device redirects non-axial flow so that it is generally parallel with the fan axis (and thereby perpendicular to the radiator), thus providing smoother flow through the radiator. Smoother flow equates with reduced entrance loss, which in turn, permits higher volumetric flow. The redirection of flow also results in a conversion of kinetic (i.e., velocity) energy into static pressure, which also contributes to increased air flow through the radiator. Thus, the overall efficiency of the cooling system is improved.

Preferred embodiments of the present invention are described above. Those skilled in the art will recognize that many embodiments are possible within the scope of the invention. Variations, modifications, and combinations of the various parts and assemblies can certainly be made and still fall within the scope of the invention. Thus, the invention is limited only by the following claims, and equivalents thereto.

What is claimed is:

1. A device to control air flow between a fan and a radiator in a fan-radiator cooling system, the device comprising:

a plurality of guide vanes that radiate outwardly about a first axis from a first, inner diameter to a second, outer diameter; and a generally annular guide ring coupled to the guide vanes, wherein the guide ring is adapted to direct a portion of the air flowing through the device toward an inactive region of the radiator.

2. The device of claim 1 further comprising a supplemental ring coaxial with the guide ring and proximal the second, outer diameter.

3. The device of claim 1 wherein the guide ring further defines a second axis substantially coaxial with the first axis.

4. A device to control air flow between a fan and a radiator in a fan-radiator cooling system, the device comprising:

a plurality of guide vanes that radiate outwardly about a first axis from a first, inner diameter to a second, outer diameter; and a generally annular guide ring coupled to the guide vanes, wherein the guide ring is adapted to direct a portion of the air flowing through the device toward an inactive region of the radiator, wherein the guide vanes comprise a first plurality of outer guide vanes and a second plurality of inner guide vanes.

5. The device of claim 4 wherein the outer guide vanes extend outwardly from the guide ring and the inner guide vanes extend inwardly from the guide ring.

6. A device to control air flow between a fan and a radiator in a fan-radiator cooling system, the device comprising:

a plurality of guide vanes that radiate outwardly about a first axis from a first, inner diameter to a second, outer diameter; and a generally annular guide ring coupled to the guide vanes, wherein the guide ring is adapted to direct a portion of the air flowing through the device toward an inactive region of the radiator, wherein the guide ring has an entrance diameter for receiving the air flow from the fan and an exit diameter for delivering the air flow to the radiator, wherein the entrance diameter is larger than the exit diameter.

7. The device of claim 6 wherein the guide ring further comprises a diverging region medial to the entrance and exit diameters, the diverging region having an expansion diameter wherein the expansion diameter is larger than the entrance and exit diameters.

8. A device to control air flow between a fan and a radiator in a fan-radiator cooling system, the device comprising:

a plurality of guide vanes that radiate outwardly about a first axis from a first, inner diameter to a second, outer diameter; and a generally annular guide ring coupled to the guide vanes, wherein the guide ring is adapted to direct a portion of the air flowing through the device toward an inactive region of the radiator, wherein the guide ring is located such that the average volumetric flow rate per unit area outside the guide ring is approximately equal to the average volumetric flow rate per unit area inside the guide ring.

9. A device to control air flow between a fan and a radiator in a fan-radiator cooling system, the device comprising:

a plurality of guide vanes that radiate outwardly about a first axis from a first, inner diameter to a second, outer diameter; and a generally annular guide ring coupled to the guide vanes, wherein the guide ring is adapted to direct a portion of the air flowing through the device toward an inactive region of the radiator, wherein the guide vanes have a leading edge generally parallel to the air flow entering the device and a trailing edge adapted to deliver the air flow generally parallel to the first axis.

10. A device to control air flow between a fan and a radiator in a fan-radiator cooling system, the device comprising:

a plurality of guide vanes that radiate outwardly about a first axis from a first, inner diameter to a second, outer diameter;

a generally annular guide ring coupled to the guide vanes, wherein the guide ring is adapted to direct a portion of the air flowing through the device toward an inactive region of the radiator; and a supplemental ring coaxial with the guide ring and proximal the first, inner diameter.

11. A device to control air flow between a fan and a radiator in a fan-radiator cooling system, the device comprising:

a plurality of guide vanes that radiate outwardly about a first axis from a first, inner diameter to a second, outer diameter;

a generally annular guide ring coupled to the guide vanes, wherein the guide ring is adapted to direct a portion of the air flowing through the device toward an inactive region of the radiator; and a first supplemental ring coaxial with the guide ring and proximal the second, outer diameter and a second supplemental ring also coaxial with the guide ring and proximal the first, inner diameter.

12. A fan-radiator cooling system comprising:

an axial fan having a plurality of fan blades emanating from a central hub wherein the central hub has a hub diameter and the fan blades define a blade diameter;

a radiator downstream and spaced apart from the axial fan; and a guiding device between the axial fan and the radiator, the device comprising:

a plurality of stationary guide vanes that radiate outwardly about a first axis from a first, inner diameter to a second, outer diameter; and a generally annular guide ring coupled to the guide vanes, wherein the guide ring is adapted to direct a portion of the air flowing through the device toward a center region of the radiator, the guide ring defining a second axis substantially coaxial with the first axis.

13. The system of claim 12 wherein the first diameter is larger than the hub diameter.

14. The system of claim 12 wherein the second diameter is equal to or larger than the blade diameter.

15. The system of claim 12 further comprising a tubular duct spanning between the fan and the radiator, the duct adapted to contain air flowing between the fan and the radiator.

16. A fan-radiator cooling system comprising:

an axial fan having a plurality of fan blades emanating from a central hub wherein the central hub has a hub diameter and the fan blades define a blade diameter;

a radiator downstream and spaced apart from the axial fan; and a guiding device between the axial fan and the radiator, the device comprising:

a plurality of stationary guide vanes that radiate outwardly about a first axis from a first, inner diameter to a second, outer diameter; and a generally annular guide ring coupled to the guide vanes, wherein the guide ring is adapted to direct a portion of the air flowing through the device toward a center region of the radiator, the guide ring defining a second axis substantially coaxial with the first axis, wherein the guide vanes have a leading edge generally aligned with the air flow generated by the fan and a trailing edge aligned to direct the air flow generally perpendicular to the radiator.

17. A fan-radiator cooling system comprising:

an axial fan having a plurality of fan blades emanating from a central hub wherein the central hub has a hub diameter and the fan blades define a blade diameter;

a radiator downstream and spaced apart from the axial fan; and a guiding device between the axial fan and the radiator, the device comprising:

a plurality of stationary guide vanes that radiate outwardly about a first axis from a first, inner diameter to a second, outer diameter; and a generally annular guide ring coupled to the guide vanes, wherein the guide ring is adapted to direct a portion of the air flowing through the device toward a center region of the radiator, the guide ring defining a second axis substantially coaxial with the first axis, wherein the guide ring is located intermediate to the first diameter and the second diameter.

18. A fan-radiator cooling system comprising:

an axial fan having a plurality of fan blades emanating from a central hub wherein the central hub has a hub diameter and the fan blades define a blade diameter;

a radiator downstream and spaced apart from the axial fan; and a guiding device between the axial fan and the radiator, the device comprising:

a plurality of stationary guide vanes that radiate outwardly about a first axis from a first, inner diameter to a second outer diameter; and a generally annular guide ring coupled to the guide vanes, wherein the guide ring is adapted to direct a portion of the air flowing through the device toward a center region of the radiator, the guide ring defining a second axis substantially coaxial with the first axis, wherein the guide vanes comprise a first plurality of outer guide vanes and a second plurality of inner guide vanes.

19. A generator set comprising:

a heat-producing prime mover;

a converting apparatus that converts work output of the prime mover into electrical energy; and a cooling system for removing heat generated by the prime mover, the cooling system comprising:

an axial fan having a plurality of fan blades emanating from a central hub;

a radiator downstream and spaced apart from the axial fan; and a guiding device between the axial fan and the radiator, the device comprising:

a plurality of stationary guide vanes that radiate outwardly about a first axis from a first, inner diameter to a second, outer diameter; and a generally annular guide ring coupled to the guide vanes, wherein the guide ring is adapted to direct a portion of the air flowing through the device toward a center region of the radiator, the guide ring defining a second axis substantially coaxial with the first axis.

20. A method for using an axial fan to push air through a radiator, the method comprising:

providing a cooling system comprising:

an axial fan, the fan having a plurality of blades coupled to a rotating hub, the hub adapted to selectively receive power from a power source;

a radiator positioned generally perpendicular to an axis of the axial fan and located downstream therefrom; and a guiding device intermediate the fan and radiator;

generating air flow by selectively engaging the power source to rotate the fan blades; and directing the air flow with the guiding device so that a portion of the flow is directed to a center region of the radiator.

21. The method of claim 20 further comprising redirecting non-axial flow produced by the fan in a direction perpendicular to the radiator.

* * * * *

UNITED STATES PATENT AND TRADEMARK OFFICE

CERTIFICATE OF CORRECTION

PATENT NO. : 6,309,178 B1
DATED : October 30, 2001
INVENTOR(S) : Young S. Kim, William F. Gevers and Constantine Xykis It is certified that error appears in the above-identified patent and that said Letters Patent is hereby corrected as shown below:

Column 10,
Line 55, insert -- , -- after "second".

Signed and Sealed this

Twenty-eighth Day of May, 2002

*Attest:*

*Attesting Officer*

JAMES E. ROGAN
*Director of the United States Patent and Trademark Office*